US005191932A

United States Patent [19]

Seefried et al.

[11] Patent Number: 5,191,932

[45] Date of Patent: Mar. 9, 1993

[54] OILFIELD CEMENTING TOOL AND METHOD

[76] Inventors: Douglas Seefried, 1602 Summit Street, S.W., Calgary, Alberta, Canada, T3C 2M1; Vernon E. Stone, #30, 185 Woodridge Drive, S.W., Calgary, Alberta, Canada, T2W 3X7

[21] Appl. No.: 727,080

[22] Filed: Jul. 9, 1991

[51] Int. Cl.[5] ..... E21B 33/16; E21B 34/10

[52] U.S. Cl. ..... 166/291; 166/155; 166/156; 166/317; 166/325

[58] Field of Search ..... 166/291, 317, 156, 155, 166/153, 325

[56] References Cited

U.S. PATENT DOCUMENTS

| | | | |
|---|---|---|---|
| 2,004,606 | 6/1935 | Halliburton . | |
| 2,071,392 | 2/1937 | Crowell . | |
| 2,141,370 | 12/1938 | Armentrout . | |
| 2,161,284 | 6/1939 | Crowell . | |
| 2,169,356 | 8/1939 | Dyer | 166/155 |
| 2,197,396 | 4/1940 | Maines | 166/155 |
| 2,217,708 | 10/1940 | Scaramucci . | |
| 2,560,901 | 7/1951 | Smith | 166/155 |
| 2,630,179 | 3/1953 | Brown | 166/291 |
| 2,635,697 | 4/1953 | Cannon | 166/155 |
| 3,087,551 | 4/1963 | Kerver | 166/317 |
| 3,117,627 | 1/1964 | Jarboe, Jr. | 166/142 |
| 3,366,182 | 1/1968 | Solum | 166/317 X |
| 3,395,759 | 8/1968 | Talley, Jr. | 166/155 |
| 3,412,797 | 11/1968 | Huitt et al. | 166/156 X |
| 4,589,495 | 5/1986 | Langer et al. | 166/156 X |

*Primary Examiner*—Stephen J. Novosad
*Attorney, Agent, or Firm*—Roper & Quigg

[57] ABSTRACT

A method of cementing oil well casings and a cementing tool used when performing the method are provided. A novel top cementing plug functions in a conventional manner during proper oil well casing cementing operations, but if inserted into the oil well casing in error, allows cement to be pumped through it. The top plug includes an outer, hard rubber casing having vertically spaced fins formed about its circumference. A central passage is provided through the outer casing and receives a cylindrical, metal sleeve. In one embodiment, a bore is formed in a portion of the metal sleeve to define a shoulder within the sleeve. The bore receives a cylindrical housing which carries a spring loaded, ball valve mechanism. The valve mechanism includes an annular spring retainer which rests on the shoulder. One end of a helical spring within the housing contacts the retainer while the other end of the spring biases a ball against an annular flange at the top of the housing to seal the passage. The ball moves into the housing and compresses the spring when an increased pressure is applied to the top of the ball thereby opening the passage. In a second embodiment, the bore formed in the cylindrical sleeve is reduced in depth but still defines a shoulder. A burst plate sits on the shoulder to block the passage in normal operation. The burst plate is designed to rupture under increased pressure to open the passage, but maintains intact in normal operation.

16 Claims, 5 Drawing Sheets

OILFIELD CEMENTING TOOL AND METHOD

The present invention relates to the cementing of oil well casings and in particular to cementing tools used in the process of cementing oil well casings.

Conventional completion techniques for oil well casings require the placement of preformed metal conduit or casing into the well bore and then cementing the annular space between the casing and the walls of the well bore. Typically, these operations have involved the use of cementing tools to locate the cement between the walls of the well bore and the outer wall of the casing.

In normal practise, when it is desired to cement the casing, a bottom plug is placed in the casing and a slug of cement is pumped into the casing on top of the bottom plug. Once the desired amount of cement is pumped into the casing, a solid top plug is placed into the casing above the slug of cement. Rotary fluid is then pumped into the casing on top of the top plug to force both the top and bottom plugs and the slug of cement down the casing. Downward movement of the top and bottom plugs and the slug of cement occur until the bottom plug abuts the top of the float collar or float shoe.

Once the bottom plug contacts the float collar or float shoe and its downward movement is inhibited, the pressure built up above it by the rotary fluid being pumped into the casing is sufficient to actuate a valve or rupture a thin membrane in the bottom plug. Once the valve has been opened or the membrane ruptured, cement is allowed to flow through the bottom plug, out through the float shoe and into the annular space between the walls of the well bore and the outer wall of the casing. As cement is expressed from the casing, the pressure built up above the top plug by the rotary fluid moves the top plug downward within the casing towards the bottom plug. This operation continues until the top plug abuts the bottom plug at which time, the entire cement slug is expressed from the casing into the annular space between the outer wall of the casing and the walls of the well bore.

Prior art cementing methods using the above-described technique are shown in U.S. Pat. No. 2,004,606 to Halliburton, U.S. Pat. Nos. 2,071,396 and 2,161,284 to Crowell, U.S. Pat. No. 2,141,370 to Armentrout, U.S. Pat. No. 2,169,356 to Dyer, and U.S. Pat. No. 2,217,708 to Scaramucci.

Although this technique is satisfactory in normal operation, problems sometime arise when the top, solid cementing plug is inadvertently placed in the oil well casing instead of the bottom plug, and the slug of cement is pumped into the casing on top of it. As should be apparent, since conventional top cementing plugs are solid, when the slug of cement and improperly inserted top plug are forced to the bottom of the oil well casing and the top plug contacts the float collar or float shoe, a complete block of the oil well casing occurs. This is due to the fact that no means are available at the bottom of the oil well casing to allow for the expression of the cement from within the casing into the annular space formed between the walls of the well bore and the outer wall of the casing. When this occurs, costs are increased significantly as the cementing operation must be stopped and the casing drilled out to remedy the situation.

It is therefore an object of the present invention to provide a novel cementing tool and method for cementing oil well casings.

According to one aspect of the present invention there is provided a cementing tool for placement in an oil well casing between a slug of cement and a secondary fluid pumped into the casing during the cementing operation thereof, said cementing tool comprising:

a generally cylindrical body having an outer surface for sealing engagement with the interior wall of said oil well casing and having passage formed therethrough; and pressure actuated valve means within said passage, in normal operation, said pressure actuated valve means being in a condition to block said passage, said valve means being actuable to an open condition under increased downward pressure thereon not normally encountered during said normal operation to permit fluid thereabove to pass through said cementing tool via said passage.

In one embodiment, it is preferred that the pressure actuated valve means is in the form of a ball valve mechanism located within the passage formed through the cementing tool body. It is also preferred that the ball valve mechanism is biased to a condition to block the passage by a helical spring.

In another embodiment, it is preferred that the pressure actuated valve means is in the form of a rupture plate located within the passage which under normal operation is capable of withstanding the downward pressure applied to it by the secondary fluid being pumped into the oil well casing, but which ruptures upon the application of the increased downward pressure.

According to another aspect of the present invention there is provided a method of cementing an oil well casing comprising the steps of:

(i) inserting a bottom cementing plug into said casing;

(ii) pumping a desired amount of cement into said casing on top of said bottom cementing plug;

(iii) inserting a top cementing plug into said casing on top of said cement, said top cementing plug including pressure actuated value means normally in a closed condition but actuable to an open condition under increased downward pressure thereon to permit fluid flow through said top cementing plug;

(iv) pumping fluid into said casing at a first pressure on top of said top cementing plug to move said bottom and top cementing plugs and said cement downward to the bottom of said casing, said bottom cementing plug providing a passage for cement therethrough when at the bottom of said casing;

(v) continuing the pumping of said fluid into said casing at said first pressure when said bottom cementing plug is at the bottom of the casing to move the top cementing plug towards the bottom cementing plug and force the cement therethrough until the top cementing plug abuts the bottom cementing plug; and (vi) wherein steps (iv) and (v) are performed at a second pressure greater than the first pressure when the top cementing plug is inadvertently placed into the casing at step (i) and the bottom cementing plug is inadvertently placed into the casing at step (iii) to actuate the pressure actuated valve means to the open condition and allow cement to pass therethrough and out of the casing.

The present invention also provides in an oil well cementing method wherein top and bottom cementing tools are placed in an oil well casing above and below a desired amount of cement and fluid is pumped into the casing at a first pressure on top of the top cementing tool to move the top and bottom cementing tools and the cement to the bottom of the casing, the bottom cementing tool allowing cement to pass therethrough and out of the casing when its downward movement is inhibited adjacent the bottom of the casing while the fluid is being pumped into the casing at the first pressure to cause the top plug to move towards the bottom plug, the improvement comprising:

providing a valve mechanism in the top cementing tool which is maintained in a closed condition at the first pressure but which is conditioned to an open condition at an increased pressure; and increasing the pressure of the fluid being pumped into the casing to actuate the valve mechanism to the open condition if the top cementing tool is inadvertently placed in the casing below the desired amount of cement and the bottom cementing tool is inadvertently placed in the casing above the desired amount of cement, the valve mechanism allowing cement to pass therethrough and be expressed from the casing.

The present invention provides advantages in that if the top plug is accidentally placed in the oil well casing, below the slug of cement, and is driven to the bottom of the oil well casing, by increasing the pump pressure forcing the rotary fluid into the casing, the valve mechanism in the top plug can be actuated to an open condition to allow the slug of cement to be expressed from the oil well casing into the annular space between the walls of the well bore and the outer wall of the casing. This avoids the expense of having to drill out the casing and allows the cementing operation to continue without significant delays which occur when a conventional top plug is used and is inadvertently inserted into the casing instead of the bottom plug.

Embodiments of the present invention will now be described in more fully with reference to the accompanying drawings.

Figure 1:
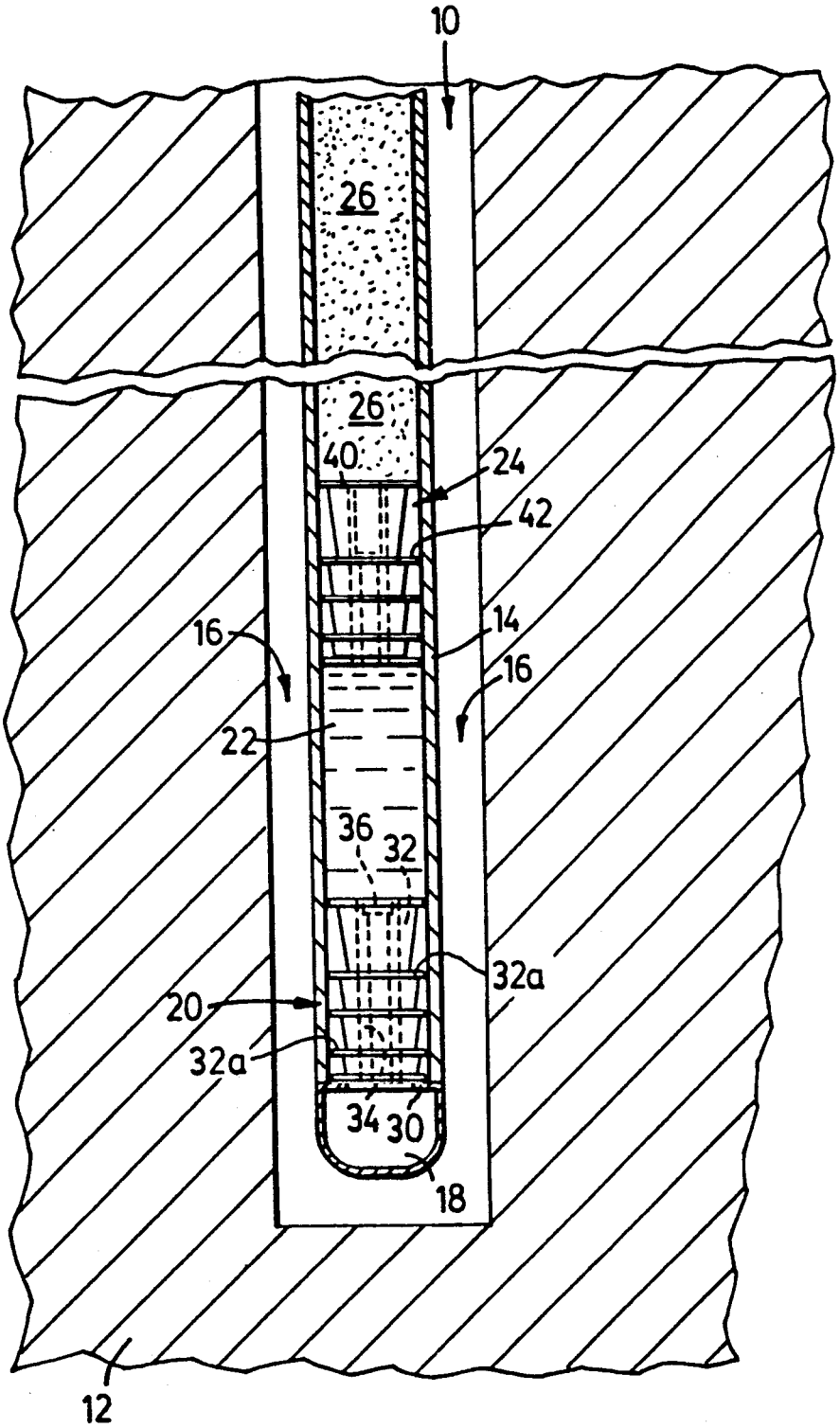
FIG. 1 is a sectional view of an oil well casing in the cementing process.

Referring to FIG. 1, a vertical well bore 10 formed in an earth formation 12 is shown. Within the well bore 10 is located an oil well casing 14 which extends from the ground level surface downwardly into the well bore 10. This defines an annular space 16 between the outer wall of the oil well casing 14 and the walls of the well bore 10.

Located at the bottom of the oil well casing 14 is a float shoe 18 which provides an opening to permit fluid flow from within the oil well casing 14 to the annular space 16. A bottom cementing plug 20 is shown within the casing 14 below a slug of cement 22. A top cementing plug 24 is positioned above the slug of cement 22 but it disposed below rotary fluid 26 filling the casing 14 above the top plug 24. The two cementing plugs 20, 24, the slug of cement 22 and the rotary fluid 26 are movable downwardly within the casing 14 until the bottom plug 20 abuts a restriction 30 at the bottom of the casing 14 adjacent the float shoe 18, the restriction being constituted by the top of the float shoe.

The bottom cementing plug 20 is of a conventional design and includes a hard rubber, cylindrical outer casing 32 having vertically spaced fins 32*a* formed about its circumfrence. The fins 32*a* sealingly engage the interior wall of the casing 14. A passage extends through the plug 20 and is positioned along the axis of the plug. The inside diameter of the outer casing 32 is lined with a cylindrical aluminum sleeve 34. A thin membrane of rubber 36 covers the top of sleeve 34 to block the passage. The membrane 36 is however, rupturable under pressures applied to it during normal operation as will be described.

Figure 2:
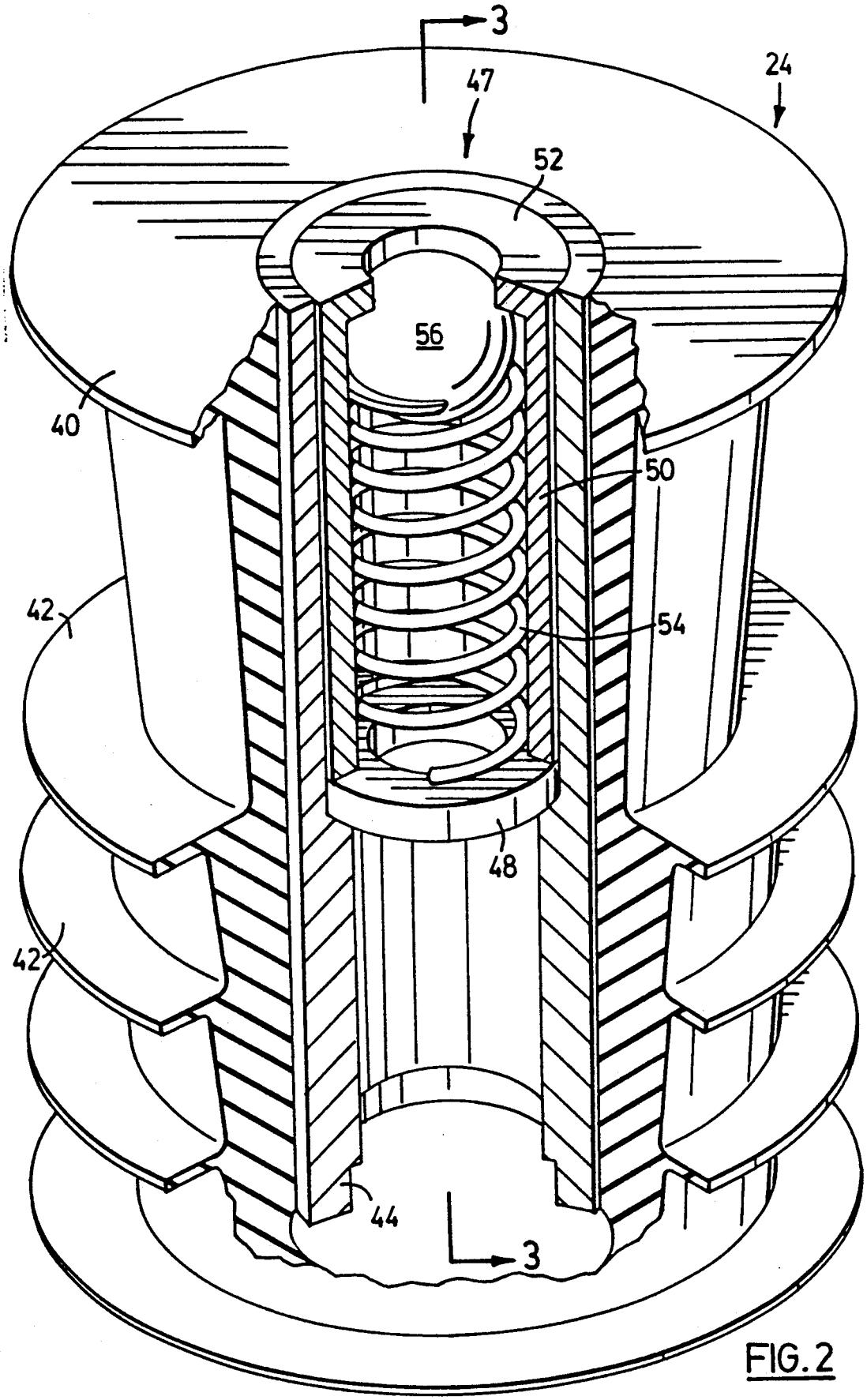
FIG. 2 is a perspective view, partly in section, of a first embodiment of a cementing tool used in an oil well casing cementing process.
Figure 3:
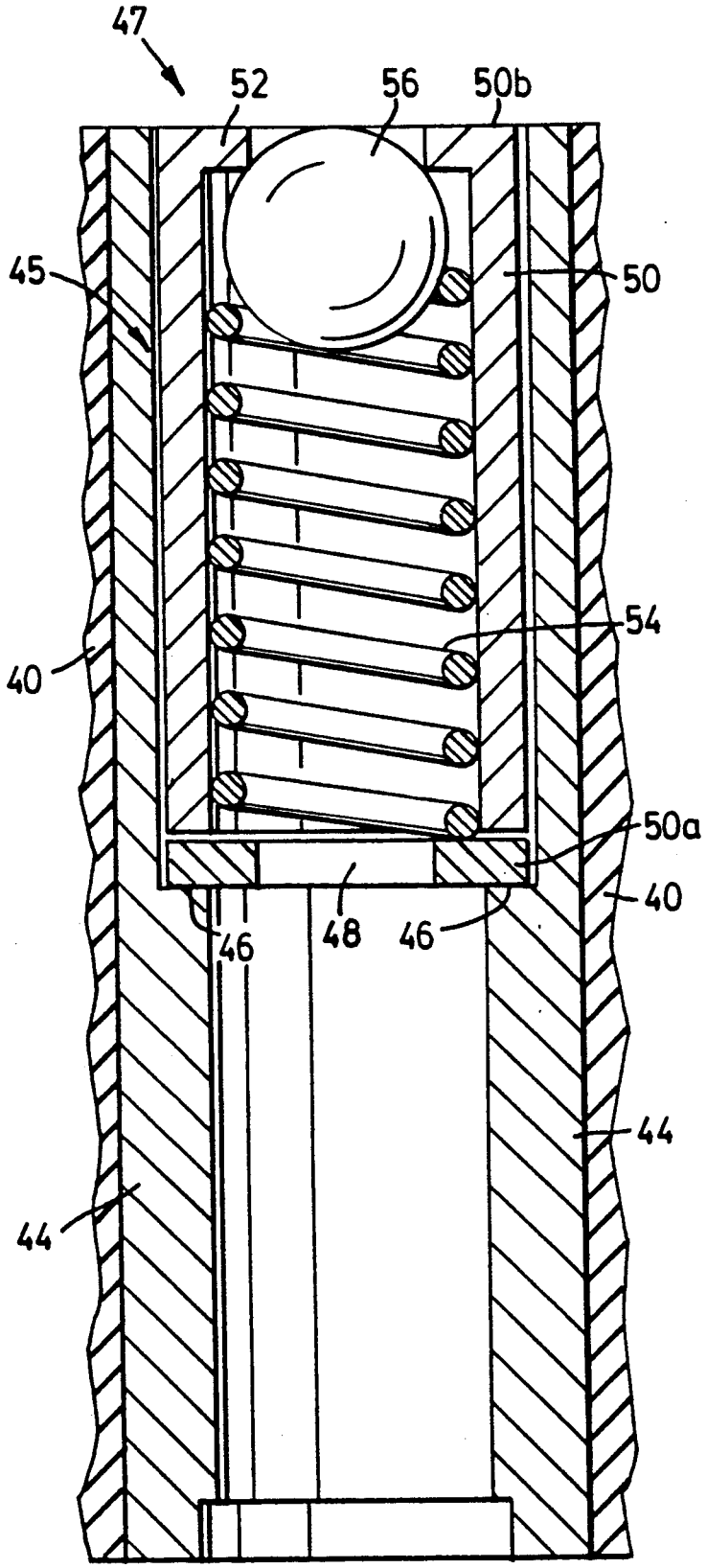
FIG. 3 is a sectional view of the cementing tool shown in FIG. 2 taken along line 3—3.

Referring now to FIGS. 2 and 3, an embodiment of the top cementing plug 24 is better illustrated and can be seen includes an outer casing 40 formed hard rubber. Vertically spaced fins 42 are also formed about the circumfrence of the casing 40 and sealingly engage with the interior wall of the casing 14. The outer casing 40 has a central, cylindrical passage formed through it. A cylindrical sleeve 44 formed from aluminum is fitted into the passage. A section 45 of the sleeve 44 near its upper end is bored to define an annular shoulder 46. A spring loaded, ball valve mechanism 47 is received in section 45 of the sleeve 44.

The valve mechanism 47 includes an annular retainer 48 which abuts with the shoulder 46 and is secured thereto be epoxy. A cylindrical housing 50 formed of aluminum is secured to section 45 of the sleeve 44 by epoxy and has one end 50*a* which contacts the retainer 48. The outer end 50*b* of the housing has an inwardly extending annular flange 52 intergral therewith. The upper surfaces of the flange 52 and housing 50 respectively are in line with the upper surface of the casing 40.

Within the cylindrical housing 50 is a helical spring 54 and a ball 56. The lower end of the spring 54 also abuts the retainer 48 while the upper end of the spring contacts the ball 56. The spring 54 forces the ball 56 upwardly to contact the interior circular edge of the flange 52 thereby sealing the passage through the top plug 24. The spring 54 preferably has a spring constant so that the spring 54 maintains the ball 56 against the annular flange 52 until a predetermined increased presure is exerted downwardly on the ball 56, at which point, the spring 54 compresses and the ball 56 moves into the housing 50.

In normal operation, when it is desired to cement the annular space 16 between the outer wall of the casing 14 and the walls of the well bore 10, the bottom plug 20 is placed into the casing 14 and the desired amount of cement 22 is pumped into the casing 14 on top of the bottom plug 20. The pump pressure forcing the cement into the casing, forces the bottom plug 20 down the casing 14. Once the desired amount of cement has been pumped into the casing, the top plug 24 is placed into the casing 14 and rotary fluid 26 is pumped into the casing 14 on top of the top plug 24. The pump pressure forcing the rotary fluid 26 into the casing 14 is sufficient to force the bottom plug 20, the slug of cement 22 and the top plug 24 down the casing.

When the bottom plug 20 contacts the restriction at the top of the float shoe 18 positioned at the bottom of the casing 14, its downward movement is inhibited. The pressure built up above the bottom plug 20 by the pump introducing rotary fluid into the casing 14, causes the thin rubber membrane 36 to rupture, thereby allowing fluid flow through the bottom plug 20 and further downward movement of the top plug 24. This, of course, forces the cement 22 located between the top and bottom plugs 20, 24 respectively through the bottom plug 20. The cement passing through the bottom plug 20 passes through the opening in the float shoe 18 and fills the annular space 16 between the walls of the well bore 10 and the outer wall of the casing 14. Downward movement of the top plug 24 continues until the top plug 24 contacts the bottom plug 20 to express completely the cement 22 from the casing 14. At this point in time, the oil well casing cementing operation is considered finished.

During normal operation, the pressure applied to the top plug 24 by the rotary fluid 26 to force it and the cement down the casing 14 and to force the cement through the bottom plug 20 and into the annular space 16 is insufficient to open the valve mechanism 47 in the top plug 24 after the top plug 24 contacts the bottom plug 20. This prevents the expression of rotary fluid from the casing. However, if the top plug 24 is anadvertently placed in the casing 14 instead of the bottom plug 20 and the slug of cement 22 is pumped into the casing 14 on top of the top plug, the following steps are performed to permit the oil well cementing operation to continue without requiring the casing 14 to be drilled out.

If the top plug 24 is inadvertently placed in the casing and cement 22 is pumped into the casing on top of it, whether or not the inadvertent placement of the top plug has been realized, the cement pumping operation is continued until the desired amount of cement is located in the casing. Once this is done, and the bottom plug 20 is placed on the top of the cement 22, rotary fluid 26 is pumped into the casing 16 above the bottom plug. The inadvertently placed top plug 24, the slug of cement 22 and the inadvertently placed bottom plug 20 are forced down the casing 14 under the pump pressure until the inadvertently placed top plug 24 abuts the restriction at the top of the float shoe 18.

When this occurs, the pump pressure forcing the rotary fluid 26 into the casing 14 is increased sufficiently to a pressure exceeding the strength of the vertical spring 54 so that the downward pressure applied to the top of the inadvertently placed top plug 24 is sufficient to force the ball 56 downwardly into the housing 50 and compress the spring 54. Once the ball 56 moves into the housing, a passage allowing cement 22 to flow through the inadvertently placed top plug 24 is provided. This permits further downward movement of the bottom plug 20 and forces the cement through the inadvertently placed top 24 plug and the float shoe 18 and into the annular space 16. The increased pressure is maintained until the bottom plug 20 contacts the inadvertently placed top plug 24 thereby completing the cementing operation.

Figure 4:
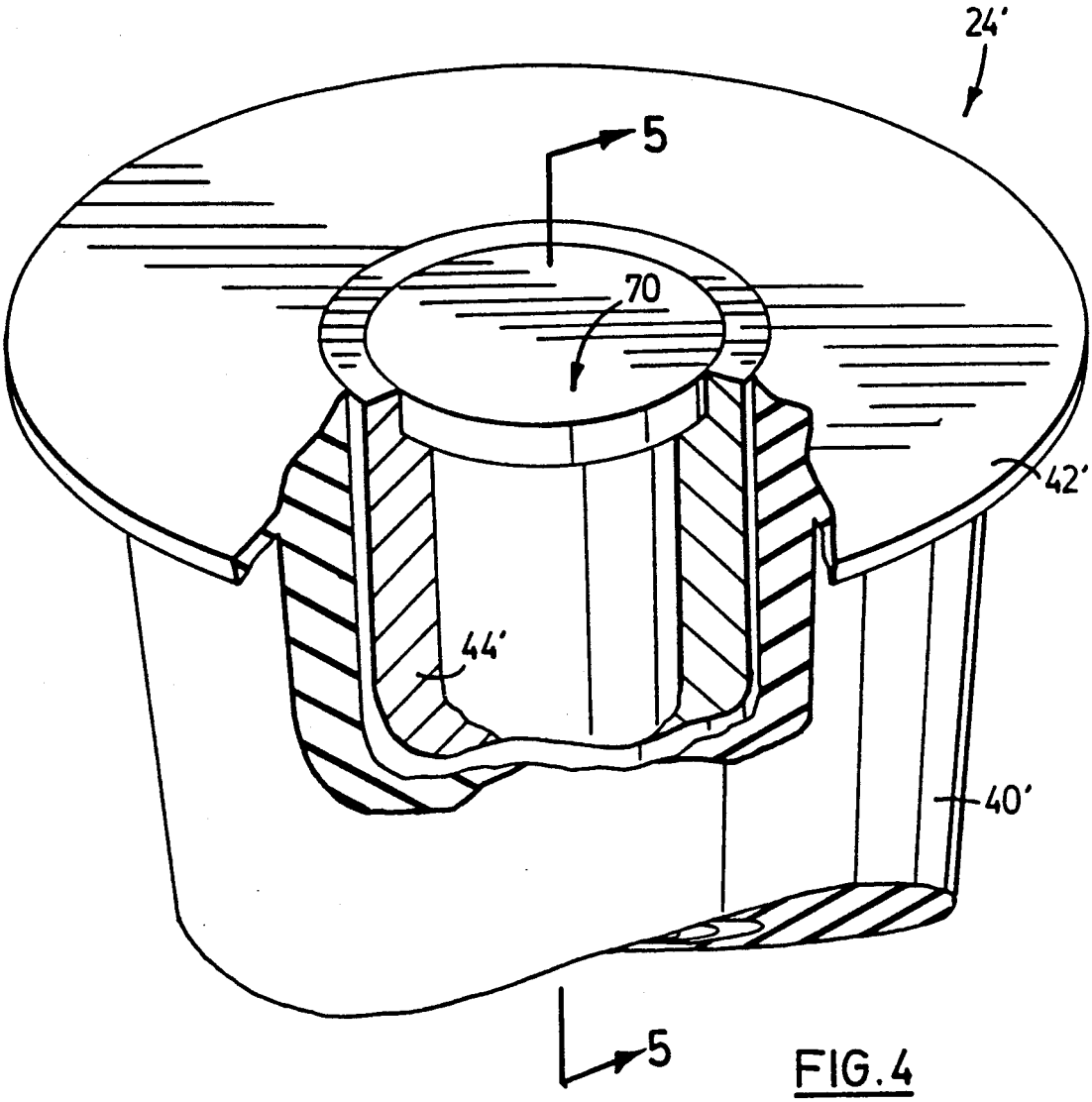
FIG. 4 is a perspective view, partly in section, of another embodiment of a cementing tool.
Figure 6:
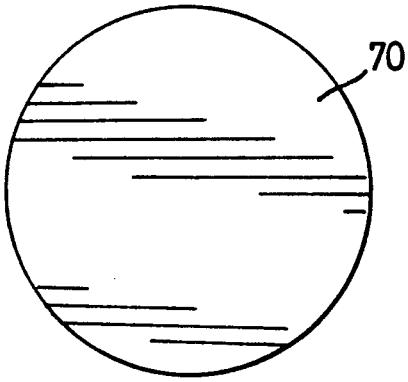
FIG. 6 is a top plan view of a portion of the cementing tool shown in FIG. 4.
Figure 5:
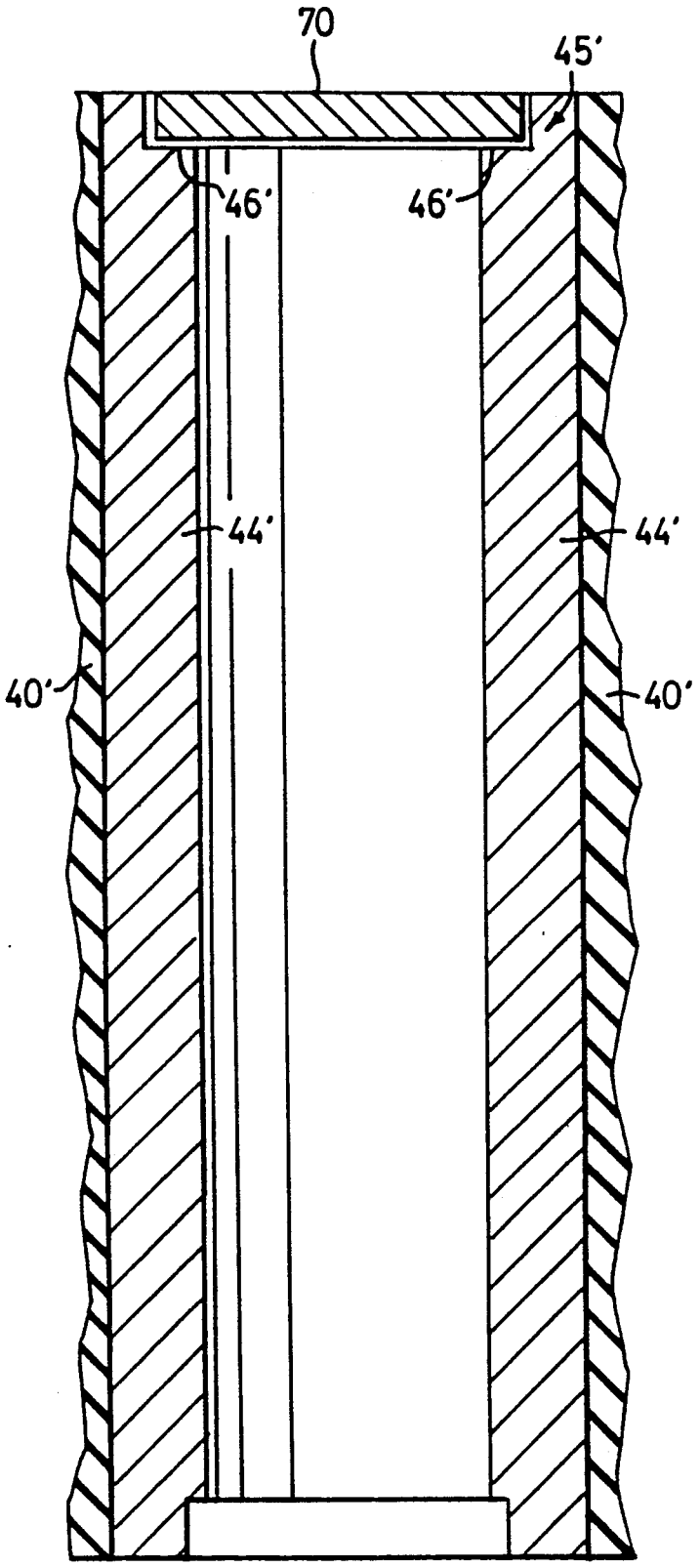
FIG. 5 is a sectional view of the cementing tool shown in FIG. 4 taken along line 5—5.

Referring now to FIGS. 4 and 5, another embodiment of the top plug is shown. In this embodiment, like reference numerals will be used to indicate like components with "'" added for clarity. In this embodiment, the top plug 24' similarly includes an outer casing 40' formed of hard rubber having vertically spaced fins about its circumference. A central, cylindrical passage is also formed through the top plug 24'. A cylindrical aluminum sleeve 44' is fitted into the passage. A section 45' of the sleeve 44' is bored to define an annular shoulder 46'. A burst plate 70 in the form of a puck sits in the section 45' and abuts the shoulder 46'. The burst plate 70 may be punched from an aluminum sheet and is secured to the shoulder 46' and the interior wall of the sleeve section 45' by epoxy. Thus, the burst plate 70 seals the interior passage of the plug 24'.

The burst plate 70 is designed to withstand the pressures applied to it by the rotary fluid 26 during normal operation, but ruptures under the increased pressure should the top plug 24' be inadvertently placed in the casing 14 below the slug of cement 22. The design of the burst plate 70 is dependent on the diameter of the oil well casing 14 such that increased pressures are required to rupture the burst plate 70 for smaller diameter oil well casings. Preferably, the burst plate 70 is designed to rupture when a pressure differential equal to approximately 80% of the burst pressure of the casing at the bottom of the well bore exists. This is achieved by selecting a suitable material for the burst plate which has a sufficient strength and is of a sufficient thickness to achieve the desired position.

Although two embodiments of a top plug 24 have been described, it should be realized by those of skill in the art that depending on the type of cementing operations to be performed, one top plug has advantages over the other. For example, if it is known that the top plug must be drilled out of the casing a after the cementing operation has been performed, use of the top plug 24' provides advantages by eliminating the need to drill out the ball valve mechanism. Also, if it desired to increase fluid pressure within the casing but maintain the valve mechanism in the top plug in a closed condition, the top plug 24' provides advantages. This is in view of the fact that it is difficult to design a spring to maintain a no flow characteristic at high pressures. The top plug 24 provides the advantage in that it closes after the cement has been expressed from the casing.

It should be apparent to those of skill in the art that the present invention provides an elegant solution to overcome the disadvantages associated with using conventional solid top plugs should they inadvertently be inserted in the oil well casing at the wrong stage of the cementing operation. Unlike conventional techniques, the present design permits the cementing operation to continue if the above occurs.

We claim:

1. A cementing tool for placement in a well casing between a slug of cement and a secondary fluid pumped into the casing during the cementing operation thereof, said cementing tool comprising:

a generally cylindrical body having an outer surface for sealing engagement with the interior wall of said well casing and having an interior passage therethrough; and pressure actuated valve means within said passage, wherein in normal operation, said pressure actuated valve means is in a condition to block said passage to allow said cementing tool to force cement down said well casing under the pressure of said secondary fluid, said pressure actuated valve means being actuable to an open condition under increased downward pressure not normally encountered during said normal operation and when a pressure differential equal to approximately 80% of the burst pressure of said casing is placed thereon to permit cement thereabove to pass through said cementing tool via said passage if said cementing tool is placed in said well casing before said cement.

2. A cementing tool as defined in claim 1 wherein said pressure actuated valve means is in the form of a ball valve mechanism.

3. A cementing tool as defined in claim 2 wherein said ball valve mechanism is biased to the condition wherein said passage is blocked by a helical spring.

4. A cementing tool as defined in claim 1 wherein said pressure actuated valve means is in the form of a rupture plate located within said passage.

5. A cementing tool as defined in claim 4 wherein said rupture plate is formed from aluminum.

6. A method of cementing a well casing comprising the steps of:

(i) inserting a bottom cementing plug into said casing;

(ii) pumping a desired amount of cement into said casing on top of said bottom cementing plug;

(iii) inserting a top cementing plug into said casing on top of said cement, said top cementing plug including pressure actuated valve means normally in a closed condition but actuable to an open condition under increased downward pressure thereon to permit fluid flow through said top cementing plug;

(iv) pumping fluid into said casing at a first pressure on top of said top cementing plug to move said bottom and top cementing plugs and said cement downward to the bottom of said casing, said bottom cementing plug providing a passage for cement therethrough when at the bottom of said casing;

(v) continuing the pumping of said fluid into said casing at said first pressure when said bottom cementing plug is at the bottom of the casing to move the top cementing plug towards the bottom cementing plug and force the cement therethrough until the top cementing plug abuts the bottom cementing plug; and (vi) wherein steps (iv) and (v) are performed at a second pressure greater than the first pressure when the top cementing plug is placed into the casing at step (i) and another cementing plug is placed into the casing at step (iii) to actuate the pressure actuated valve means to the open condition and allow cement to pass therethrough and out of the casing.

7. In a well cementing method wherein top and bottom cementing tools are in a well casing above and below a desired amount of cement and fluid is pumped into the casing at a first pressure on top of the top cementing tool to move the top and bottom cementing tools and the cement to the bottom of the casing, the bottom cementing tool allowing cement to pass therethrough and out of the casing when its downward movement is inhibited adjacent the bottom of the casing while the fluid is being pumped into the casing at the first pressure to cause the top plug to move towards the bottom plug, the improvement comprising:

providing a valve mechanism in the top cementing tool which is maintained in a closed condition at the first pressure but which is conditioned to an open condition at an increased pressure; and increasing the pressure of the fluid being pumped into the casing to actuate the valve mechanism to the open condition if the top cementing tool is placed in the casing below the desired amount of cement and another cementing tool is placed in the casing above the desired amount of cement, the valve mechanism allowing cement to pass therethrough and be expressed from the casing.

8. The method of claim 6 wherein at step (vi), steps (iv) and (v) are performed at a second pressure sufficient to place a pressure differential on said pressure actuated valve means equal to approximately 80% of the burst pressure of said casing.

9. The method of claim 7 wherein said pressure is increased to place differential on said valve mechanism equal to approximately 80% of the burst pressure of said casing.

10. The method of claim 9 wherein said valve mechanism is in the form of a rupture plate.

11. A well casing cementing kit for use in a well casing cementing operation comprising:

a bottom cementing plug for placement in said well casing below a slug of cement, said bottom cementing plug having a generally cylindrical body with an outer surface for sealing engagement with the interior wall of said well casing and having an interior first passage therethrough, said bottom cementing plug including valve means to seal said passage but actuable to an open condition under a first pressure when said bottom cementing plug is adjacent the bottom of said well casing to permit cement to flow therethrough; and a top cementing plug for placement in said casing above said slug of cement and below a secondary fluid pumped into the casing during the cementing operation thereof, said top cementing tool for forcing cement down said casing under the pressure of said secondary fluid and including a generally cylindrical body having an outer surface for sealing engagement with the interior wall of said well casing and having an interior second passage therethrough, said top cementing tool further including pressure actuated valve means within said second passage, in normal operation, said pressure actuated valve means being in a condition to block said passage, said pressure actuated valve means being actuable to an open condition under increased downward pressure thereon greater than said first pressure not normally encountered during said normal operation to permit cement thereabove to pass through said top cementing tool via said second passage when said top cementing tool is placed into said casing below said slug of cement.

12. A kit as defined in claim 11 wherein said pressure actuated valve means is in the form of a rupture plate.

13. A kit as defined in claim 12 wherein said rupture plate remains intact to block said second passage until a pressure differential is placed on said rupture plate equal to approximately 80% of the burst pressure of said casing.

14. A top cementing plug for placement in a well casing in normal operation between a slug of cement and a secondary fluid pumped into the casing during the cementing operation thereof, said top cementing plug comprising:

a generally cylindrical body having an outer surface for sealing engagement with the interior wall of said well casing and having an interior passage therethrough; and pressure actuated valve means within said passage, in normal operation, said pressure actuated valve means being in condition to block said passage, said valve means being actuable to an open condition under increased downward pressure thereon not normally encountered during said normal operation to permit cement thereabove to pass through said cementing tool via said passage, said body having a bottom end for contacting said cement and adapted to force cement down said casing and a top end to be contacted by said secondary fluid, said top end being constituted by at least a portion of said pressure actuated valve means.

15. A cementing plug as defined in claim 14 wherein said pressure actuated valve means is in the form of a rupture plate,

16. A cementing plug as defined in claim 15 wherein said rupture plate is actuated to said open condition when a pressure differential equal to approximately 80% of the burst pressure of said casing is placed thereon.

* * * * *